United States Patent [19]

Gravelle

[11] Patent Number: 4,651,642

[45] Date of Patent: Mar. 24, 1987

[54] CREDIT CARD IMPRINTER WITH DISABLING MEANS

[75] Inventor: David E. Gravelle, Great Houghton, England

[73] Assignee: National Business Systems Inc., Mississauga, Canada

[21] Appl. No.: 306,495

[22] Filed: Sep. 28, 1981

Related U.S. Application Data

[63] Continuation of Ser. No. 91,308, Nov. 5, 1979, abandoned.

[30] Foreign Application Priority Data

Nov. 17, 1978 [GB] United Kingdom ..... 44980/78

[51] Int. Cl.[4] ..... B41F 3/04

[52] U.S. Cl. ..... 101/269; 101/285

[58] Field of Search ..... 101/269, 285, 45, 369, 101/58

[56] References Cited

U.S. PATENT DOCUMENTS

| | | | |
|---|---|---|---|
| 3,413,922 | 12/1968 | Wike | 101/269 |
| 3,465,672 | 9/1969 | Whitfield | 101/269 |
| 3,572,242 | 3/1971 | Friend | 101/269 |
| 3,618,517 | 11/1971 | Allport | 101/269 |
| 3,673,960 | 7/1972 | Rilzi et al. | 101/269 |
| 3,693,156 | 9/1972 | Dilello | 101/269 X |
| 3,814,015 | 6/1974 | Ozahi et al. | 101/269 |
| 3,838,640 | 10/1974 | Cornell et al. | 101/269 |
| 3,859,509 | 1/1975 | Dillinghan et al. | 101/269 X |
| 3,890,899 | 6/1975 | Brugge et al. | 101/369 X |
| 3,945,316 | 3/1976 | Thomas et al. | 101/45 |

FOREIGN PATENT DOCUMENTS

| | | |
|---|---|---|
| 713218 | 8/1954 | United Kingdom . |
| 945193 | 12/1963 | United Kingdom . |
| 1332288 | 10/1973 | United Kingdom . |

OTHER PUBLICATIONS

Caybourn, IBM Tech. Discl. Bulletin, vol. 20, No. 11A, Apr., 1978, pp. 4563–4564.

*Primary Examiner*—Edward M. Coven

*Attorney, Agent, or Firm*—Antonelli, Terry & Wands

[57] ABSTRACT

A credit card imprinter is disclosed herein in which printing of the sheet is inhibited or prevented if the credit card is inadvertently incorrectly positioned on its support. The imprinter has a manually-operated printing carriage movable along a support member on which a sheet can be arranged to overlie an embossed credit card. In one embodiment a combined detent and trip mechanism is provided to prevent movement of the printing carriage over the support member and to raise a printing roller in the carriage away from the support member. The mechanism is disabled by the correct insertion of the credit card. In another embodiment, a resilient means is provided for preventing the sheet from being positioned on the support unless the credit card has been properly positioned thereon.

7 Claims, 12 Drawing Figures

Fig. 7.
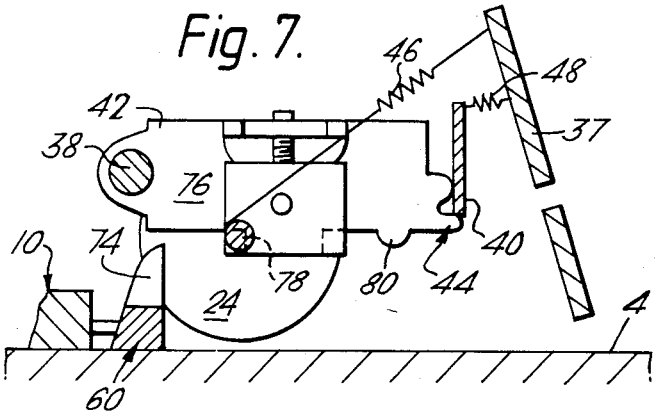
Fig. 8.
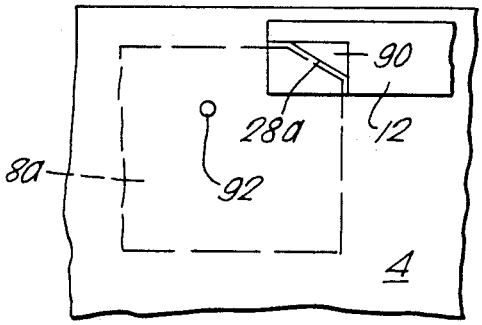
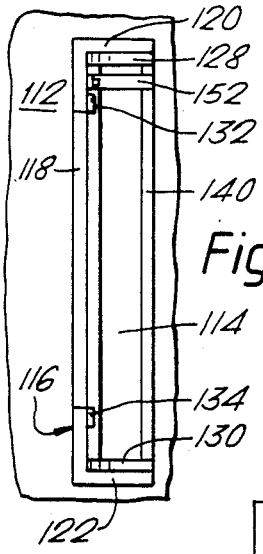
Fig. 10.
Fig. 11.
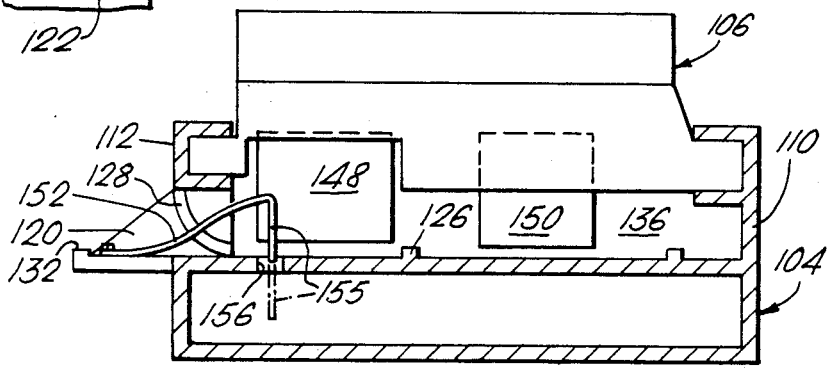

CREDIT CARD IMPRINTER WITH DISABLING MEANS

This application is a continuation, of application Ser. No. 91,308, filed Nov. 5, 1979, abandoned.

BACKGROUND OF THE INVENTION

This invention relates to printing machines.

The invention finds application, for example, in forming print impressions of a printing plate on a sheet wherein the plate is removably mounted in the machine for a limited printing run, typically for a single operation of the machine.

One example of such a printing machine, described in U.K. Patent Specification No. 1,240,418, is a credit card imprinter, where the printing plate comprises an embossed card of plastics material. The imprinter provides a support member and a printing carriage slidable therealong. The credit card is placed at a predetermined location on the support member and a sales voucher, usually comprising three sheets of specially-prepared paper, is placed along the support member so as to extend over at least the embossed portion of the credit card. A so-called "dealer plate" is permanently mounted on the support member and bears embossed information identifying the vendor. The sales voucher is arranged also to overlie the dealer plate. The printer carriage is manually moved along the support member from a starting position and a roller thereof effects printing on the voucher of the information embossed on the card and dealer plate.

It has been found in some instances with such imprinters that sales vouchers have had the dealer plate information but not the credit card information printed thereon after a printing movement of the carriage, and that this has been due to inadvertent failure of the imprinter operator to insert the credit card on the support member. In other instances, the lack of printing has been due to incorrect insertion of the card, for example such that the embossed portion thereof does not underlie the voucher. If this omission is not corrected by a further imprinting oepration with the card in place, a financial loss will be incurred by the vendor.

It is an object of the present invention to provide a printing machine in which inadvertent incomplete printing, or any inadvertent printing, of a printing sheet is substantially prevented.

SUMMARY

The invention provides a printing machine for forming print impressions of a printing plate on a sheet, comprising support means arranged removably to support said plate and said sheet, plate positioning means to position said printing plate on said support means, and prevention means arranged substantially to prevent inadvertent operation of the machine if the printing plate is incorrectly positioned relative to said plate positioning means, the arrangement being such that said prevention means is rendered inoperable, thereby to allow operation of the machine, on engagement of a printing plate with said plate positioning means.

Preferably the printing prevention means is disabled, thereby to allow printing, either in response to location of the printing plate in any orientation with respect to the plate positioning means or only in response to location of the printing plate in a specific orientation with respect to the plate positioning means.

In a first embodiment of the invention, the printing prevention means is arranged to prevent movement of a printing carriage of a printing machine.

In accordance with the first embodiment of the invention, the printing machine comprises means arranged to position the printing plate on the support means, a printing carriage arranged to move relative to the support means to effect said printing of the sheet, and the printing prevention means comprises detent means for preventing said movement of the carriage, the detent means being rendered inoperative on engagement of the printing plate with said positioning means.

The detent means may comrpise a stop member and a resiliently-biassed projection or plunger that is urged by engagement of the printing plate with the positioning means to move the stop member from a detent position in the path of the printing carriage to an inoperative position out of the path of the printing carriage.

The printing plate positioning means can comprise wall means for engagement by one or more edges or corners, and preferably at least two corners, of the plate. The projection of the detent means may then extend laterally through said wall means, and the stop member can be pivotally mounted on a side of said wall means remote from the printing plate.

The printing carriage may be arranged to have two, or more, successive parts thereof engageable by the detent means such that if the detent means is rendered inoperative only temporarily and the carriage moved a short distance, further movement to complete a printing storke can be prevented by engagement of the detent means with a furthe rpart of the carriage.

Some printing machines, and in particular the credit card imprinter of U.K. Patent Specification No. 1,240,418, operate on a forward-and-return stroke arrangement whereby printing takes place only on the forward stroke and the printing carriage in subsequently returned, either manually or automatically, along the same path to a starting position. With such an arrangement it is necessary to render the printing means, usually one or more rollers, inoperative, for example by raising it away from a support member of the printing plate and sheet, at the end of the forward stroke, to avoid printing on the return stroke, and then to reset the printing means on regaining the starting position preparatory to a further imprinting operation. In a second embodiment of the invention, the printing invention means is arranged to ensure that a printing means of the machine is in an inoperative position in the event of inadvertent omission of a printing plate from the machine.

In accordance with the second embodiment of the present invention, the printing machine comprises means arranged to position the printing plate on the support means, a printing carriage comprising printing means arranged to move relative to the support means whereby the printing means urges the printing plate and sheet into contact with each other thereby to effect said printing of the sheet, and the printing prevention means comprises trip means arranged to urge the printing means away from the support means to prevent said urging into contact of the printing plate and sheet, the trip means being rendered inoperative on engagement of the printing plate with said positioning means.

In a third embodiment of the invention, the printing prevention means comprises means arranged to prevent positioning of the printing sheet on the support means, thereby to disrupt and substantially to prevent movement of a printing means during a printing stroke, the prevention means being rendered inoperative by correct positioning of the printing plate on the support means.

The positioning of the printing sheet is preferably prevented by resilient means extending outwardly from that portion of the support means that, on correct operation of the machine, extends beneath an overlapping portion of the printing plate and sheet. Positioning of the printing plate on the support means is then arranged to bias the resilient means such as to allow positioning of the printing sheet on the support means.

In a printing machine in accordance with the third embodiment, the support means may comprise guide means, for example aperture-defining means, for each of said printing plate and sheet, and the resilient printing prevention means preferably comprises a leaf spring extending longitudinally along the plate guide means and transversely across the sheet guide means. The sheet can then be inserted through its guide means for printing only when the obstacle thereto presented by the spring has been depressed by insertion of the printing plate into its guide means.

Printing plates in the form of credit cards for use in imprinters are of substantially rectangular shape, and even though they may be positioned on a support member of a printing machine at the predetermined location, they may be incorrectly orientated, for example upside down or reversed. Incorrect orientation can lead to incomplete or inaccurate printing or a complete lack of printing on the sheet of the information on the printing plate, which if not corrected will result in financial loss to the vendor.

It is a further object of the present invention to provide a printing machine for cooperating with a printing plate whereby incorrect orientation of the printing plate thereon is prevented.

In accordance with a fourth embodiment of the invention, the printing machine comprises means arranged to position the printing plate on the support means, the positioning means being shaped, for example by appropriate shaping of wall means thereof or by comprising projections, for cooperation with a complementarily-shaped printing plate, whereby the printing plate can engage, for example by being mounted on or in, the positioning means in only one orientation.

It will be appreciated that the features of the various embodiments of the invention may be provided in one printing machine, further to minimise inadvertent incorrect operation of the machine. Accordingly, the trip means of the second embodiment may be arranged to be operable after the detent means of the first embodiment has been circumvented, so that if the detent means of the first aspect has been rendered temporarily inoperative, and thus the printing carriage allowed to move over the sheet, by inadvertent operation by an object other than a permanently-inserted printing plate, no printing will be effected. Since a printing machine, and particularly a credit card imprinter, has at least one printing plate, e.g. a dealer plate, permanently mounted thereon the likelihood is enhanced that such inadvertent mis-use of the machine will be quickly noticed.

BRIEF DESCRIPTION OF THE DRAWINGS

FIG. 7 is a part sectional side elevation of the detent and trip means and printing carriage of the imprinter of FIG. 1;

FIG. 8 is a plan view of part of a modified imprinter;

FIG. 10 is a side elevation of part of the imprinter of FIG. 9, in the direction of arrow X thereof; and FIG. 11 is a section along the line XI—XI of FIG. 9.

DESCRIPTION OF THE PREFERRED EMBODIMENTS

Figures 1, 4, 5A, 5B, 6:
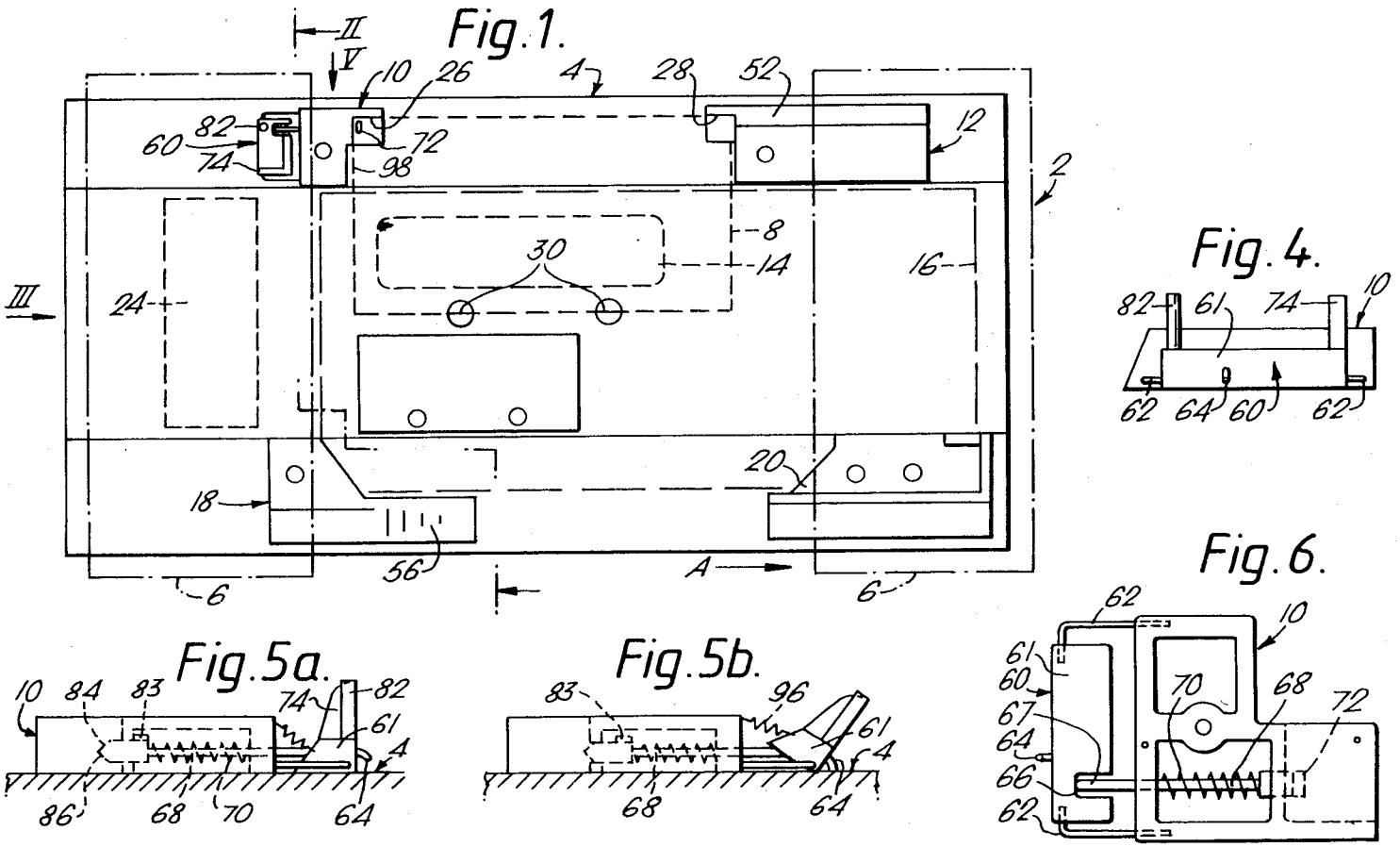
FIG. 1 is a plan view of an imprinter for use with a credit card, with a printing carriage thereof removed.
FIG. 4 shows an end elevation of detent and trip means of the imprinter in the direction of the arrow III of FIG. 1.
FIGS. 5*a* and 5*b* are side elevational views showing detent and trip means of the imprinter in an operative and inoperative position respectively.
FIG. 6 is an underneath plan view showing the detent and trip means of the imprinter.

Referring to FIGS. 1 to 7 and to FIG. 1 in particular, an imprinter 2 comprises a substantially rectangular base 4 on which a printing carriage 6 is slidably mounted so as to be moved from a start position longitudinally horizontally along the base 4 in the direction of arrow A to a position at the other end of the imprinter 2 so as to effect a printing operation. The positions of the carriage 6 before and after the printing stroke are shown in broken outline on FIG. 1 at the left hand and right hand side respectively.

The imprinter 2 is for use with a credit card 8 which is positioned on the base 4 in a predetermined relationship with locating members 10 and 12. The card 8 bears embossed characters within an embossing portion 14 thereof. The credit card 8 is substantially rectangular and is arranged to fit into correspondingly shaped corner portions 26 and 28 of the locating members 10 and 12 respectively. The card 8 is urged into abutment with the corner portions 26 and 28 by resiliently-biassed upstanding projections 30 on the imprinter base 4. A specially-prepared document or voucher 16 on which the card embossing is to be imprinted is placed on the base 4 of the imprinter 2 so as to overlie the card embossing portion 14, and is located by two further locating members 18 and 20. The document 16 also overlies an embossed dealer plate 22 which is permanently fixed to the imprinter base 4.

The printing carriage 6 carries a printing roller 24 which is arranged to urge the document 16 down on to the embossing portion 14 of the card 8 and on to the embossed dealer plate 22 as the carriage 6 is moved from one end of the imprinter base 4 to the other, to effect the printing of the document 16.

Figure 2:
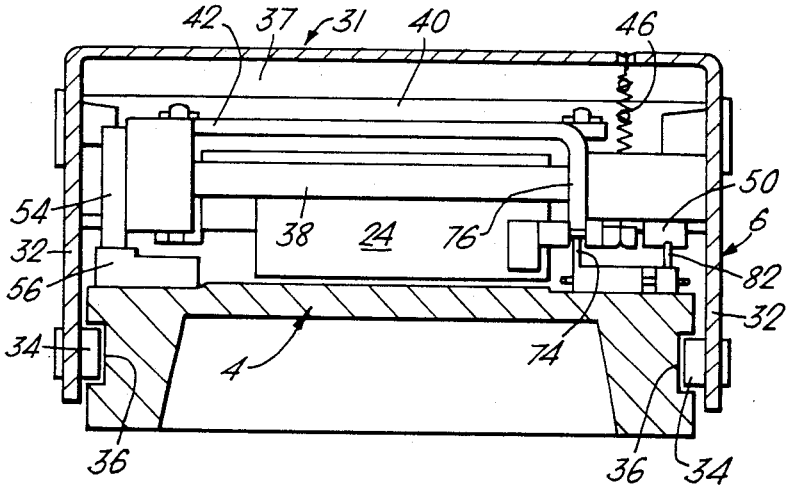
FIG. 2 is a sectional elevation along the line II of FIG. 1 with the printing carriage in place.
Figure 3:
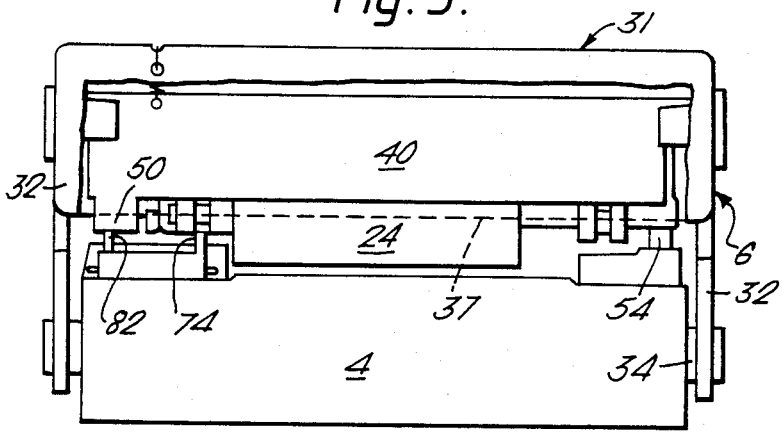
FIG. 3 is a rear elevation in the direction of the arrow III of FIG. 1, with the printing carriage in place.

Referring to FIGS. 2 and 3, the printing carriage 6, which is shown with a cover thereof removed, comprises a carriage frame 31 which has planar side portions 32 that overlap and extend parallel to the longitudinal sides of the imprinter base 4 and which carry rollers 34 that run in guide rails 36 along opposing longitudinal sides of the imprinter base 4 so as to guide the carriage 6 therealong. The side portions 32 of the main carriage frame 31 are interconnected by a planar transverse portion 37, shown in broken and dashed outline in FIG. 3. Journalled in the side portions 32 and extending therebetween parallel with the transverse portion 37 of the carriage frame 31, are a shaft 38 and a substantially vertically-orientated rectangular trip plate 40. Referring to FIG. 7, a substantially U-shaped frame 42 carrying the roller 24 is pivotally mounted on the shaft 38 and has a contoured portion 44 arranged to engage the plate 40. A spring 46 extends between the roller frame 42 and the transverse portion 37 of the carriage frame 31. The spring 46 tends to rotate the frame 42 about the shaft 38, thereby raising the roller 24 away from the imprinter base 4. The trip plate 40 is biassed towards its vertical orientation by a spring 48 extending therefrom to the transverse portion 37 of the carriage frame 31, so as to urge the trip plate 40 into engagement with the contoured portion 44 of the roller frame 42. The relative position of the imprinter parts shown in FIG. 7 is that which exists before the printing stroke, that is to say with the printing carriage 6 at the left hand end of the imprinter 2 as shown in FIG. 1.

Although the trip plate 40 is generally rectangular, it has towards one end thereof a latch 50 formed as a downwardly-projecting extension. Referring to FIG. 1, after the printing carriage 6 has been moved from its left hand start position along the base 4 of the printer and over the card 8, the downwardly-projecting latch 50 comes into abutment with an upstanding wall 52 of the locating member 12. This resistance to the further forward motion of the latch 50 causes the trip plate 40 to become disengaged from the contoured portion 44 of the roller frame 42 (FIG. 7) and the springs 46 and 48 cause the roller frame 42 and trip plate 40 to assume orientations which are slightly inclined to the horizontal and vertical planes respectively. Thus, the roller 24 is raised away from the imprinter base 4 so that on the return stroke of the printer carriage 6 to its start position no further printing is effected as the carriage passes over card 8 and overlying document 16. As the carriage 6 is returned to its start position, and after having passed over the card 8, a cam 54, which is fixed to the roller frame 42, engages a ramp 56 of the locating member 18, such that the roller frame 42 is pivoted about its shaft 38 towards its initial position. This movement of the roller frame 42 is accompanied by a returning to the vertical plane of the trip plate 40 under the action of its return spring 48, until the plate 40 and frame 42 again assume the relative positions shown in FIG. 7, with the roller 24 in its lowered position in preparation for the next printing stroke.

The base 4 of the imprinter 2 is marked "PARK HERE" at one end, corresponding to the pre-printing position of the carriage 6, to encourage an operator to return the carriage at the end of a printing stroke.

The description and construction of the printer so far described is substantially of a conventional printing machine, such as the imprinter of Specification No. 1,240,418, in which the printing carriage can be moved irrespective of whether a printing plate, such as the card 8 is in position. The locating member 10 of the imprinter 2, however, is provided with a combined detent/trip mechanism 60. The mechanism 60 comprises a detent/-trip carrier 61 pivotally mounted on two arms 62 that are secured within the locating member 10 on the side opposed to that arranged to receive the embossed credit card 8. The pivotal mounting of the carrier 61 is such that it is rotatable away from the locating mebmer 10 about a transverse axis substantially parallel with the imprinter base 4 and in a general direction opposed to the direction of motion of the carriage 6 during its forward stroke. The degree of rotation is determined by a rearwardly projecting spigot 64 of the carrier 61. The carrier 61 has a cut-out 66 that is open-ended towards the rear of the locating member 10 and which receives one end 67 of an elongate plunger 68 that is mounted in the locating member 10. The plunger 68 is biassed by a spring 70 through a wall of the locating member 10 so as to project the other end 72 thereof into the corner portion 26. When the end 72 of the plunger 68 is urged rearwardly so as to compress the spring 70, its other end 67 causes the carrier 61 to rotate about its mounting arms 62.

The carrier 61 comprises a substantially triangular stop member 74 extending upwardly therefrom which is aligned longtiduinally of the imprinter base 4 with a downwardly-extending side arm 76 of the U-shaped roller frame 42. The height of the stop member 74 is such that when the carrier 61 is in its operative position (FIG. 5*a*), movement of the printing carriage 6 from its start position brings a step 78 (FIG. 7) of the roller frame side arm 76 into abutment with the stop member 74 in a direction opposed to the allowed direction of rotation of the carrier 61. Thus, the stop member 74 prevents the advancement of the printing carriage 6. However, when the carrier 61 is in its inoperative position (FIG. 5*b*) the top of the trigger 74 is below the level of the frame step 78 so that the printing carriage 6 can freely traverse the imprinter base 4.

The carrier 61 is movable to its inoperative position, in particular, by the insertion of the credit card 8 into the corner portion 26 of the locating member 10, thus urging the plunger 68 of the detent/trip mechanism 60 rearwardly. It will be appreciated, however, that the end 72 of the plunger 68 could be urged rearwardly to allow the frame step 78 of the printing carriage to travel along the imprinter base 4 a short distance beyond the stop member 74 of the carrier 61, and the plunger 68 could then be released. To prevent completion of the carriage stroke the imprinter 2 provides a further stop means in the form of a pip 80 extending downwardly from the roller frame 42 in longitudinal alignment with the step 78 and spaced rearwardly thereof. The subsequent release of the plunger 68 referred to above would result in the detent/trip carrier 61 regaining its upright position, and provided the carriage 6 has not travelled sufficiently far along the base 4 its movement will be arrested by engagement of the pip 80 with the stop member 74. In general, therefore, the plunger 68 will have to be permanently withdrawn into the locating member 10 in order for the printing carriage 6 to complete a printing stroke from one end of the imprinter base 4 to the other. In normal use, this will ensure that the card 8 has to be in place before the printing carriage 6 can be moved from the start position, and has to remain in place throughout the printing stroke.

The carrier 61 of the detent/trip mechanism 60 also comprises a trip member 82 extending upwardly therefrom and spaced transversely from the stop member 74. The trip member 82 is longitudinally aligned with the latch 50 of the trip plate 40. The height of the trip member 82 is such that with the carrier 612 in its operative position (FIG. 5*a*), and disregarding stop member 74, movement of the carriage 6 from its rest position causes the latch 50 to impinge upon the trip member 82, thereby disengaging the trip plate 40 from the roller frame contoured portion 44, resulting in the roller frame 42 rotating to lift the roller 24 away from the imprinter base 4. This movement of the roller frame 42 and trip plate 40 is the same as that described above which takes place in normal use when the carriage 6 reaches the end of its forward stroke. Thus, although further movement of the printing carriage 6 may take place along the imprinter base 4 and over the card 8 and document 16, this will not give rise to printing of the document 16 since the roller 24 will be spaced therefrom. When the carrier 62 is in its inoperative position (FIG. 5*b*) the trip member 82 is lowered below the level of the latch 50 of the trip plate 40 so that the roller 24 is not raised from the imprinter base 4. As described above, this condition arises when the plunger 68 of the detent/trip mechanism 60 is urged rearwardly, generally in use by insertion of the credit card 8 in the locating member 10.

It will be appreciated that the detent/trip carrier 61 is arranged to return to its operative position on release of the plunger 68, under the influence of its own weight. Although this is usually satisfactory, since the imprinter 2 is generally used on a horizontal surface, it may in some instances be desirable to provide a more positive return of the carrier 61. To this end, a spring 96 may be provided to interconnect the upper surface of the carrier 61 with the locating member 10. It will be appreciated that the strength of the spring 96 will be chosen in dependence of the strength of the plunger-biassing spring 70 so that no undue force is required to insert the card 8 in the corner portion 26 of the locating member 10.

It will be appreciated that provision of stop member 74 and trip member 82 may be provided in a printing machine as alternatives, or one may be used to supplement the other. When either member 74 or 82 is provided, no printing can take place unless the plunger 68 is urged rearwardly and maintained rearwardly until the printing carriage 6 is beyond the mechanism 60. When used in combination, it will be appreciated that since the trip plate 40 is disposed rearwardly of the step 78 and of the pip 80, which are engageable with the stop member 74, then even if the carrier 61 is rendered inoperative until the pip 80 has passed the member 74, the trip member 82 can still engage the latch 50 and thus, whilst the carriage is free to move along the base 4, prevent printing of the document 16.

Although the end 72 of the plunger 68 may be cylindrical and free to rotate about its axis, it is preferred that it be guided by having a spigot 83 thereof engage an appropriate channel in the locating member 10. It will be appreciated, however, that the end 72 may be provided as a square or other section so as to fit into a correspondingly-shaped aperture in the locating member 10, thereby to prevent rotation of the plunger 68. It is also desirable that the end 72 of the plunger be chamfered to provide an upper sloping surface 84 to allow the card 8 to be pressed conveniently into position in the corner portion 26, and a lower sloping surface 86 to provide an overlap for subsequently retaining the card 8 in position.

It will be appreciated that a detent and/or trip mechanism other than that particularly described herein may be used so to prevent movement of a printing carriage in a printing machine, or to prevent printing in the event such movement takes place, in the absence of a printing plate.

It will be appreciated that with the imprinter 2, the carriage 6 can still traverse the base 4, and can do so in a printing mode, even if the card 8 is inserted in position upside down or reversed. In either of these events, the embossing portion 14 of the card 8 either will not be in the path of the roller 24 or will not be in contact with the document 16. Accordingly, the imprinter 2 may be modified as shown in FIG. 8 for cooperation with a correspondingly-prepared printing plate or card 8*a*.

In one of the modifications shown in FIG. 8, the locating member 12 is shaped to provide a corner portion 28*a* that will receive a corner of the card 8*a* which is of different contour from the other three corners of the card. The corner 28*a* is formed by a triangular-shaped insert 90, which alternatively can be provided integrally with the locating member 12, such that the locating member 12 will accept only a printing plate having a corner cut away therefrom. Thus, the card 8*a* can be inserted in the locating members 10 and 12 in only one orientation, which is that providing the embossed portion 14 extending upwardly in the path of the roller 24.

In another modification shown in FIG. 8, the base 4 of the imprinter 2 is provided with an upward projection 92 between the locating members 10 and 12 and outside the path of the roller 24. The corresponding printing plate for use with such a machine has an aperture therein arranged to fit over the projection 92 only when the card is correctly positioned in the locating members 10 and 12.

The locating member 10, as well as being provided with a corner portion 26 has a further corner portion 98, whereby the imprinter 2 can accommodate two discrete sizes of credit card. It will be appreciated that the corner portion 98 can be provided with means arranged to form part of the detent/trip mechanism 60 for use with a credit card that fits therein. Such means may be a plunger corresponding to the plunger 68 which may act directly on the carrier 61 or be interconnected with plunger 68.

The modification described with reference to FIG. 8 which results in corner portion 28*a* may alternatively or additionally be carried out correspoindingly to the locating member 10. The locating members 10 and 12 are secured to the imprinter base 4 by screws, so that existing printing machines may conveniently be modified not only as described with reference to FIGS. 1 to 7 but also with reference to FIG. 8 simply by replacing one or more of the locating members 10 and 12. Furthermore, the locating members maybe interchangeable for cooperation with different printing printing plates on an otherwise identical positioning means.

The embodiment of the printing machine shown in FIGS. 9, 10 and 11 will now be described. An imprinter 100 comprises a substantially L-shaped stand 102, a support member 104 and a printing carriage 106. The stand 102 has a planar base 108 for mounting on a table or other operating surface, so as to dispose the support 104 substantially vertically. The carriage 106 moves downwardly from a start position as shown in FIG. 9 along the support member 104 towards the stand 102, and is then returned by springs (not shown) to the start position.

Figure 9:
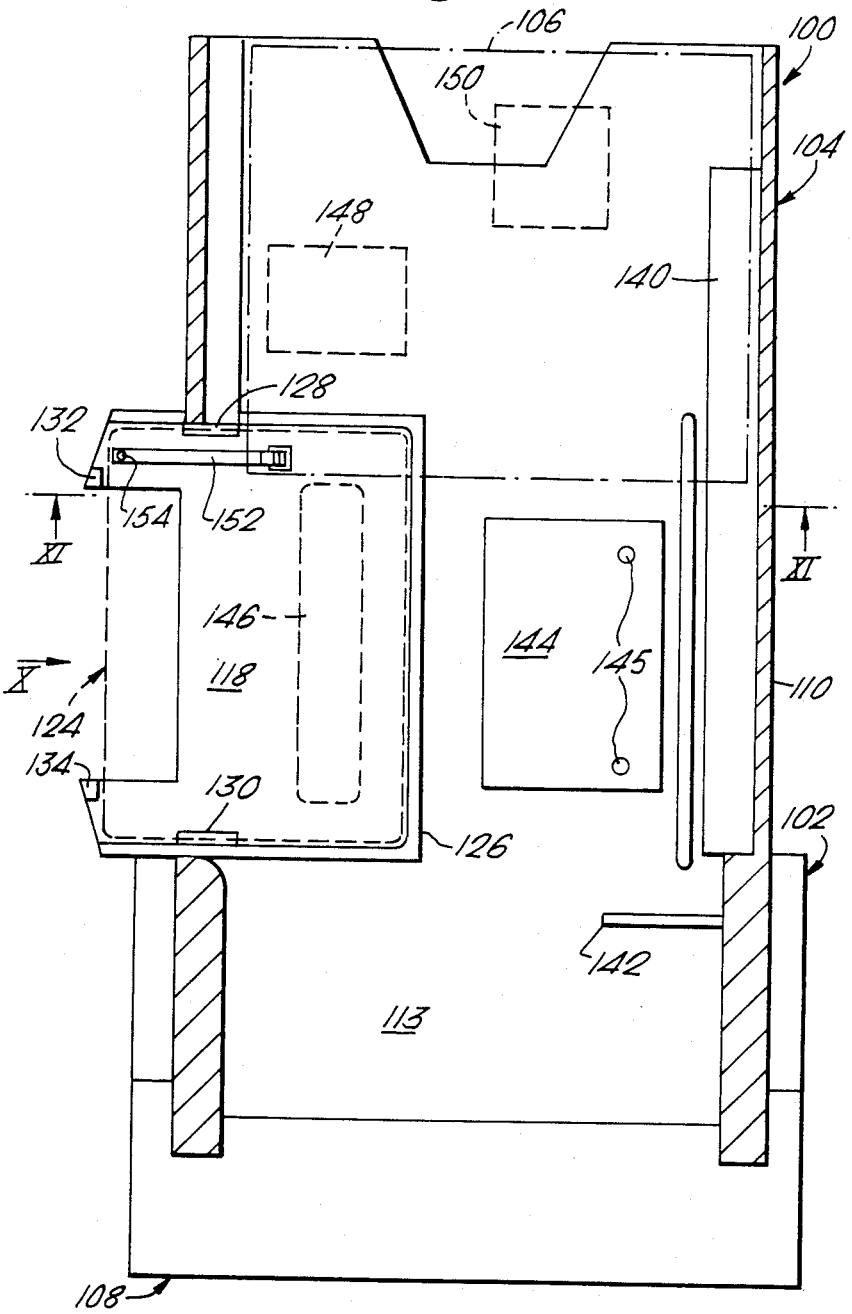
FIG. 9 is a partially cut away front elevation of another embodiment of a credit card imprinter.

For convenience, the printing carriage 106 is shown only in broken outline in FIG. 9, and planar side walls 110 and 112 extending substantially perpendicularly of a back plate 113 of the support 104 are shown in section, so as to disclose clearly the means by which a credit card, or other printing plate, and sales voucher, or other printing sheet, are introduced into the imprinter 100.

The side wall 112 of the support 104 has a substantially rectangular aperture 114 therein which is arranged to eceive the credit card. Within the aperture 114 is disposed a guide member 116 that comprises a planar base 118 and upstanding walls 120, 122 extending perpendicularly at a pair of opposing edges thereof. The separation of the walls 120, 122 is arranged to be equal to the length of a credit card 124, such that the card is guided thereby for insertion in a substantially vertical plane into the imprinter 100. the base 118 is provided with an upsstanding wall 126 at its inner end so as to restrict the degree of insertion of the credit card 124. The wall 122 is also provided with two depending resilient arms 128 and 130, which extend into the aperture 114 and serve to urge the card 124 against the base 118 of the guide member 116, thereby securing the card 124 to the printer support 104. Two projections 132 and 134 at the outer end of the guide member base 118 further assist in the retention of the credit card 124.

The sale voucher is introduced into the imprinter 100 through an aperture 136 at the top thereof, such that the voucher enters the imprinter downwardly and transversely to the introduction of the card 124. The aperture 136 extends between the back plate 113 of the support 104 and the imprinting carriage 106, over the back plate 113 and under an overhanging ledge 140 extending inwardly from the side wall 110 of the support 104. The extent of introduction of the sale voucher is limited in the downward direction by a short transverse wall 142 extending upwardly from the back plate 113.

A dealer plate 144 is permanently fixed by screws 145 to the back plate 113, the plate 144 bearing embossed information indentifying the vendor. When the sale voucher is properly introduced into the imprinter 100, it overlies the dealer plate 144 and an embossed portion 146 of the credit card 124. The printing carriage 106 is then manually operated so as to be moved from its rest position at the top of the support 104 downwards towards the stand 102. During this movement, rollers 148 and 150 of the printing carriage effect printing of the information embossed on the card 124 and dealer plate 144 on the sales voucher. The printing carriage 106 is then returned to its start position by springs (not shown) disposed within the side walls 110 and 112.

In accordance with the present invention, the imprinter 100 is provided with a device whereby the printing operation described above cannot be properly carried out unless the printing card 124 is inserted. To this end, the card guide member 116 has affixed to the base thereof a flat spring 152 that comprises a steel strip which is riveted at one end 154 to the base 118 at the entry to the aperture 114. The spring 152 extends away from its fixed end 154 through the aperture 114 so as to be disposed across the entry path of the sales voucher into the imprinter 100. The free end 155 of the spring 152 is curved downwardly towards an aperture 154 in the imprinter back plate 113.

In the detent position of the spring 152, as shown in full outline in FIGS. 10 and 11, the introduction of a sales voucher into the imprinter 100 for allowing printing thereof is prevented by engagement of the voucher with the free end of the spring 152 at the upstream end of the guide member 116. Thus, the sales voucher cannot be arranged to overlie the locations of either the credit card 124 or the dealer plate 144. On insertion of a credit card 124 into the guide member 116, however, the card passes over the top of the fixed end of the spring 152 and urges the free end 155 of the spring through the aperture 154 into the imprinter support 104 and out of the path of the sale voucher. Complete insertion of the voucher can then take place and the printing operation carried out.

It will be appreciated that the resistance to deformation of the spring 152 is less than that of the card-retaining members 128 and 130, so that the card 124 is securely held against the back plate 113 in opposition to the tendency of the spring 152 to return from its depressed position, shown in outline in FIG. 11, to its raised position.

It is envisaged that resilient means such as the spring 152 of the embodiment of FIG. 9 of the imprinter may be used additionally, or alternatively, to the detent means or trip means of previous embodiments of printing machines.

It will be appreciated that a printing plate other than a credit card, for example an identify card, may be used with the imprinter of the present invention.

I claim:

1. An imprinter for forming print impressions of an embossed card on a sheet, comprising:

(a) support means for removably supporting said card and said sheet as a printing carriage is slidably moved over said support means;

(b) a printing carriage mounted for sliding movement over said support means, said printing carriage including roller means adapted to urge said card and said sheet into contact with one another to effect printing on said sheet;

(c) prevention means for normally preventing complete insertion of said sheet onto said support means;

(d) guide means for said card and said sheet positioned for engagement by said card and operable to act, in combination with said card, to disable said prevention means and allow complete insertion of said sheet onto said support means in overlapping relationship with said card.

2. An imprinter as claimed in claim 1 wherein said embossed card is a credit card, said sheet is a sales voucher, said guide means comprise first guide means for guiding said credit card onto said support means and engaging said credit card in proximity to a dealer plate mounted on said support means, and second guide means for guiding said sales voucher onto said support means in overlapping relationship with said credit card and said dealer plate, and further wherein said prevention means comprises means for normally obstructing said sales voucher from being completely guided into said overlapping relationship.

3. An imprinter for forming print impressions of an embossed card on a sheet, comprising:

(a) support means for removably supporting said embossed card and said sheet;

(b) card positioning means for positioning said embossed card on said support means;

(c) sheet positioning means for positioning said sheet on said support means in overlapping relationship with said embossed card;

(d) a printing carriage mounted for sliding movement over said support means, said printing carriage including roller means adapted to urge said card and said sheet into contact with one another to effect printing on said sheet as said printing carriage is slidably moved over said support means;

(e) prevention means for normally preventing the positioning of said sheet on said support means, said prevention means being disabled by the engagement of said embossed card with said card positioning means to allow said sheet to be positioned on said support means.

4. An imprinter as claimed in claim 3, wherein said card positioning means comprises first guide means for guiding said embossed card onto said support means along a first path, and said sheet positioning means comprises second guide means for guiding said sheet onto said support means along a second path, and further wherein said prevention means comprises means for normally obstructing said second path in order to prevent said sheet from being guided onto said support means by said second guide means.

5. An imprinter as claimed in claim 4, wherein said prevention means comprises resilient means extending over said support means and arranged to normally obstruct said second path, and herein said resilient means is disabled from obstructing said second path by the engagment of said embossed card with said first guide means.

6. An imprinter as claimed in claim 5, wherein said resilient means comprises a leaf spring having one end affixed to said support means and the other end normally maintained out of contact with said support means, said other end being movable toward said support means upon engagement of said embossed card with said first guide means.

7. An imprinter as claimed in claim 6, wherein said leaf spring extends parallel to said first path and occupies a part of said support means that is overlaid by said embossed card and said sheet during operation of said imprinter, and wherein said leaf spring is urged toward said support means by contact with said embossed card upon engagement of said embossed card with said first guide means.

* * * * *